US012246217B1

(12) United States Patent
Colley

(10) Patent No.: US 12,246,217 B1
(45) Date of Patent: Mar. 11, 2025

(54) MULTIFUNCTIONAL PUSHUP APPARATUS

(71) Applicant: George L. Colley, Detroit, MI (US)

(72) Inventor: George L. Colley, Detroit, MI (US)

( * ) Notice: Subject to any disclaimer, the term of this patent is extended or adjusted under 35 U.S.C. 154(b) by 164 days.

(21) Appl. No.: 18/143,812

(22) Filed: May 5, 2023

Related U.S. Application Data

(60) Provisional application No. 63/364,473, filed on May 10, 2022.

(51) Int. Cl.
*A63B 23/12* (2006.01)
*A63B 21/00* (2006.01)
*A63B 22/00* (2006.01)

(52) U.S. Cl.
CPC ..... *A63B 23/1236* (2013.01); *A63B 21/4033* (2015.10); *A63B 22/0046* (2013.01)

(58) Field of Classification Search
CPC ..... A63B 21/00047; A63B 21/0005; A63B 21/00054; A63B 21/00185; A63B 21/068; A63B 21/4027; A63B 21/4029; A63B 21/4033; A63B 21/4034; A63B 21/4035; A63B 22/0046; A63B 23/12; A63B 23/1209; A63B 23/1227; A63B 23/1236; A63B 2208/0285; A63B 2208/029; A63B 2208/0295; A63B 2225/09; A63B 2225/093
See application file for complete search history.

(56) References Cited

U.S. PATENT DOCUMENTS 1,620,146 A * 3/1927 Walton ..... A63B 69/10 434/254
3,731,921 A * 5/1973 Andrews, Jr. ..... A63B 21/4029 482/56
4,332,381 A * 6/1982 Lyons ..... A63B 21/00047 482/145
4,494,532 A * 1/1985 Masuda ..... A63B 23/1227 606/244
5,106,079 A * 4/1992 Escobedo ..... A63B 21/4047 482/141
5,330,408 A * 7/1994 Westmoreland, Jr. ..... A63B 21/4033 482/141
5,472,400 A * 12/1995 Royer ..... A63B 23/16 482/141
5,582,565 A * 12/1996 Soria ..... A63B 21/00047 482/141
7,156,788 B1 * 1/2007 Jackson ..... A63B 21/4035 482/141
7,361,128 B2 * 4/2008 Chen ..... A63B 23/0211 482/145
7,637,851 B1 * 12/2009 Lormil ..... A63B 21/4035 482/141
8,465,403 B2 * 6/2013 McCall, Jr. ..... A63B 23/0205 482/148
11,154,741 B2 * 10/2021 Özgün ..... A63B 23/03525
(Continued)

*Primary Examiner* — Gary D Urbiel Goldner
(74) *Attorney, Agent, or Firm* — Gunther J. Evanina; BUTZEL LONG

(57) ABSTRACT

A multifunctional pushup table includes a freestanding frame, a body supporting section pivotally coupled to the freestanding frame, a pushup enabling section connected to the body supporting section, and a foot anchoring section attached to the body supporting section. The pushup enabling section is operable when the body supporting section is at an upright position, a horizontal position and an intermediate position relative to the freestanding frame.

10 Claims, 4 Drawing Sheets

(56) References Cited

U.S. PATENT DOCUMENTS

| | | | | |
|---|---|---|---|---|
| 2004/0097352 | A1* | 5/2004 | Bergman | A63B 21/4031 482/141 |
| 2005/0003938 | A1* | 1/2005 | Henderson | A63B 23/1227 482/142 |
| 2005/0272581 | A1* | 12/2005 | Stearns | A63B 21/4003 482/140 |
| 2008/0051273 | A1* | 2/2008 | Storch | A63B 23/12 482/141 |
| 2014/0274620 | A1* | 9/2014 | Hoole | A63B 21/4007 482/141 |
| 2015/0290486 | A1* | 10/2015 | Leone | A63B 23/1236 482/96 |
| 2017/0100627 | A1* | 4/2017 | Monti | A63B 21/068 |
| 2017/0319901 | A1* | 11/2017 | Chiang | A61H 1/0229 |
| 2019/0105527 | A1* | 4/2019 | Hallmark | A63B 23/0216 |
| 2019/0168062 | A1* | 6/2019 | Monti | A63B 23/1236 |
| 2019/0344119 | A1* | 11/2019 | Almeda | A63B 21/4035 |
| 2020/0171344 | A1* | 6/2020 | Monti | A63B 21/4029 |

* cited by examiner

MULTIFUNCTIONAL PUSHUP APPARATUS

The benefits under 35 USC 119(e) are claimed of provisional patent application 63/364,473 filed May 10, 2022.

BACKGROUND OF THE INVENTION

The present invention relates to exercise equipment and, more particularly, to a multifunctional pushup table configured to include a free-standing frame and a pushup enabling mechanism that is operable at various angles relative to a horizontal plane of the freestanding frame such that sick, elderly and disabled users can independently perform a variety of exercises.

Exercise is becoming increasingly more popular. Exercise clearly offers health benefits while recognizing that many people have difficulty in finding sufficient time in their schedule for a full workout at a health club or gymnasium. An exerciser may exercise at home whenever the exerciser's schedule permits. This flexibility in scheduling allows for a more consistent and thus healthful exercise regime. Exercise, however, has its drawbacks. In particular, in order to exercise all or most of the muscle groups, multiple pieces of exercise equipment may be required. Furthermore, these multiple pieces of equipment may require permanent installation in the exerciser's home. Notably, nonabled users (patients, sick or elderly users, etc.) are not able to independently exercise without assistance from a caregiver. This requires frequent visits to a physical therapist and the like.

Permanent or not, many popular pieces of exercise equipment occupy a great deal of space. This makes the use of the equipment impractical in homes or apartments which do not have the required extra space. Furthermore, nonpermanent pieces of equipment are often difficult to disassemble and may require added storage space even when disassembled. A user must then often choose between an exercise device providing a complete exercise regime and a device which fits the exerciser's home space.

Accordingly, a need remains for multifunctional exercise equipment in order to overcome at least one of the above-noted shortcomings. This invention satisfies such a need by means of a multifunctional pushup table configured to include a freestanding frame and a pushup enabling mechanism that is operable at various angles relative to the horizontal plane of the freestanding frame and that is convenient and easy to use, lightweight yet durable in design, versatile in its applications and structurally configured such that sick, elderly and disabled users can independently perform a variety of exercises.

DETAILED DESCRIPTION OF THE INVENTION

Figure 1:
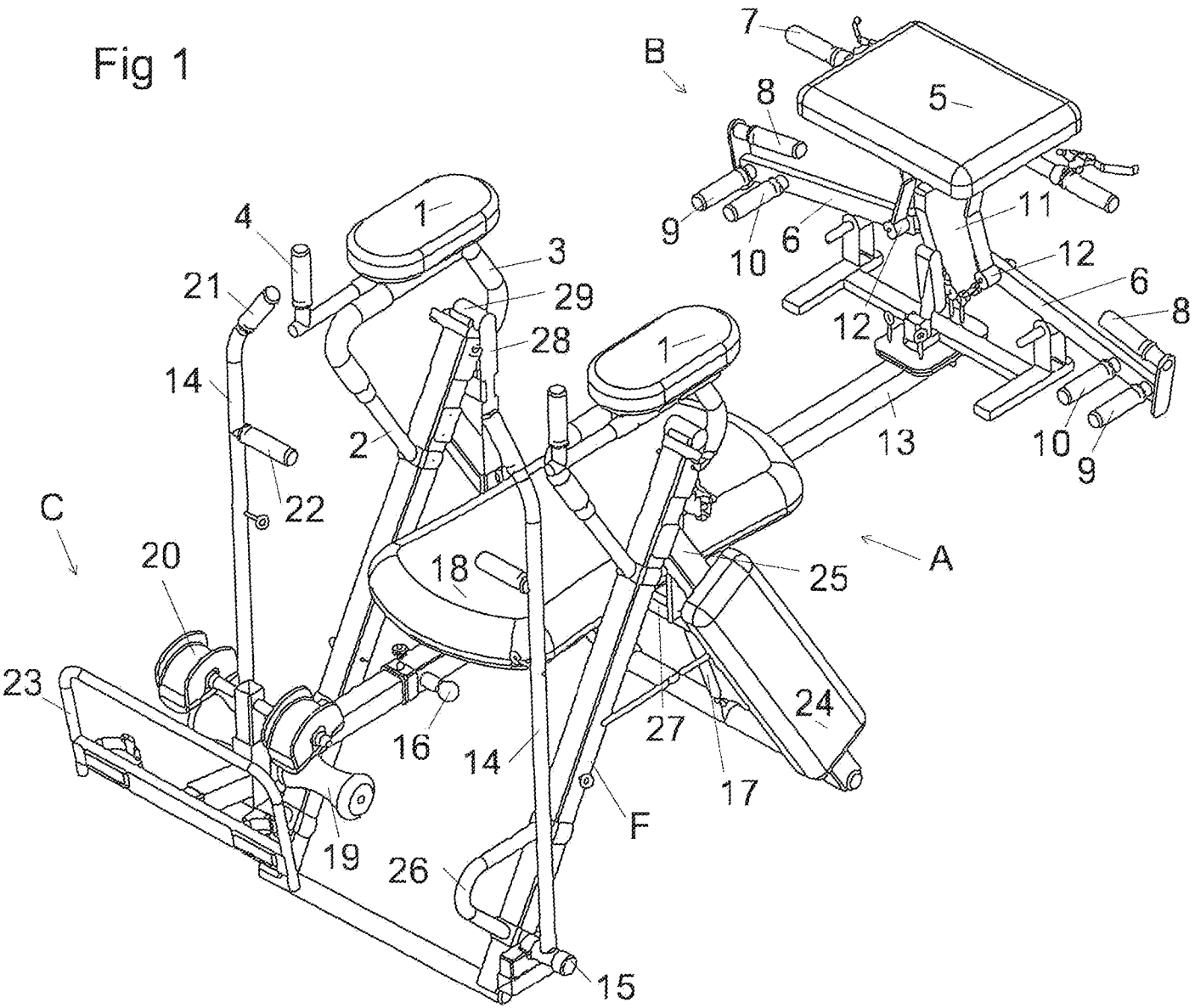
FIG. 1 is a perspective view of a multifunctional pushup apparatus according to this invention.

In one embodiment, the invention is intended to provide a multifunctional pushup table configured to include a freestanding frame and a pushup enabling mechanism that is operable at various angles relative to a horizontal plane of the freestanding frame such that sick, elderly and disabled users can independently perform a variety of exercises.

The present invention is configured to provide a home solution for the millions of impaired users who can't use traditional exercise equipment or afford continued treatment. The pushup table offers an enhancement to traditional exercise equipment that allows users who are unable to stand, or walk, to use the same exercise equipment configured for an able body user, and to use such exercise equipment effectively with results. Thus, the pushup table is configured primarily for elderly individuals, as well as those recovering from an injury or stroke. The pushup table provides users a full body workout and allows the user to do push up in six (6) different positions, with effective results from its first use, engaging muscles all over the body giving the user an entire core workout every time.

The pushup table enables the user, while at a perfect plank position, to engage core muscles all over the body at the same time. The present invention harnesses the power of the user's body weight through the innovative structural configuration that features six (6) different hand positions giving the user maximum body sculpting and rehabilitation benefits. For example, the upper grip, like swimming, works the upper back and shoulders; the inside grip targets the triceps and chest; the outer grip works the shoulders biceps and chest; the fourth, and fifth, positions provide a maximum workout the old-fashioned way, A seat is provided for squats.

The pushup table includes a pushup enabling mechanism that includes elastic bands for legs and arms; push up bars on the legs of the device; chest press exercise in seated or standing positions; push up exercise at horizontal, standing, and seated positions; and LCD fitness monitor displays exercise parameters such as total count, time, calories, distance, etc.

In general, the multifunctional pushup table includes a freestanding frame F, a body supporting section, generally indicated by the letter A, pivotally coupled to the freestanding frame, a pushup enabling section, generally indicated by the letter B, connected to the body supporting section, and a foot anchoring section, generally indicated by the letter C, attached to the body supporting section. The pushup enabling section is operable when the body supporting section is at an upright position, intermediate position or horizontal position relative to the freestanding frame.

The freestanding frame F is supported on the ground surface. The body supporting section is substantially planar and pivots to multiple positions. The foot anchoring section is located at the distal end of the body supporting section. The pushup enabling section is located at a proximal end of the body supporting section, opposite the foot anchoring section.

The pushup enabling section includes a central longitudinal axis and a base portion attached to the body supporting section with a cushion portion configured to support the upper torso of a user's body.

With reference to the drawings, a pair of arm rest cushion pads 1 are secured to frame F each by means of downwardly extending supports 2 and 3. A pair of hand grips 4 extend outwardly, respectively, from arm rest cushion pads 1.

With reference to pushup enabling section B, chest cushion 5 is interconnected to spaced support bars 6 and a pair of hand grips 7 extend outwardly from chest cushion 5. In addition, a pair of upper hand grips 8, a pair of lower outer hand grips 9 and a pair of inner hand grips 10 are interconnected, respectively, to support bars 6. Upper hand grips 8 extend inwardly and outer hand grips 9 and inner hand grips 10 extend toward body supporting section A and at right angles to hand grips 8. Support bars 6 are attached at their inner ends to vertical support bar 11 and extend outwardly therefrom. Each support bar 6 is rotational about bushing 12.

Telescoping tube 13 allows for lateral adjustability of the pushup enabling section B and foot anchoring section C. Chest press arms 14 are rotatably interconnected at the lower ends thereof to frame F and adjustable for tension by means of knob 15. Pin 16 is insertable into telescoping tube 13 for purposes of securing telescoping tube 13 in place. Shock absorber 17 provides cushioning for body pad 18.

Foot anchoring section C includes ankle and leg supports 19 as well as back ankle supports 20 which are appropriately interconnected to frame F. Hand grips 21 and second position hand grips 22 are attached to chest press arms 14.

Foot support 23 is interconnected to frame F and seat 24 is shown in a storage position in FIG. 1 and is detachable from support bar 25 which is interconnected to frame F. Seat 24 is attachable by snap fit to spaced seat supports 26 which are attached to frame F.

Figure 2:
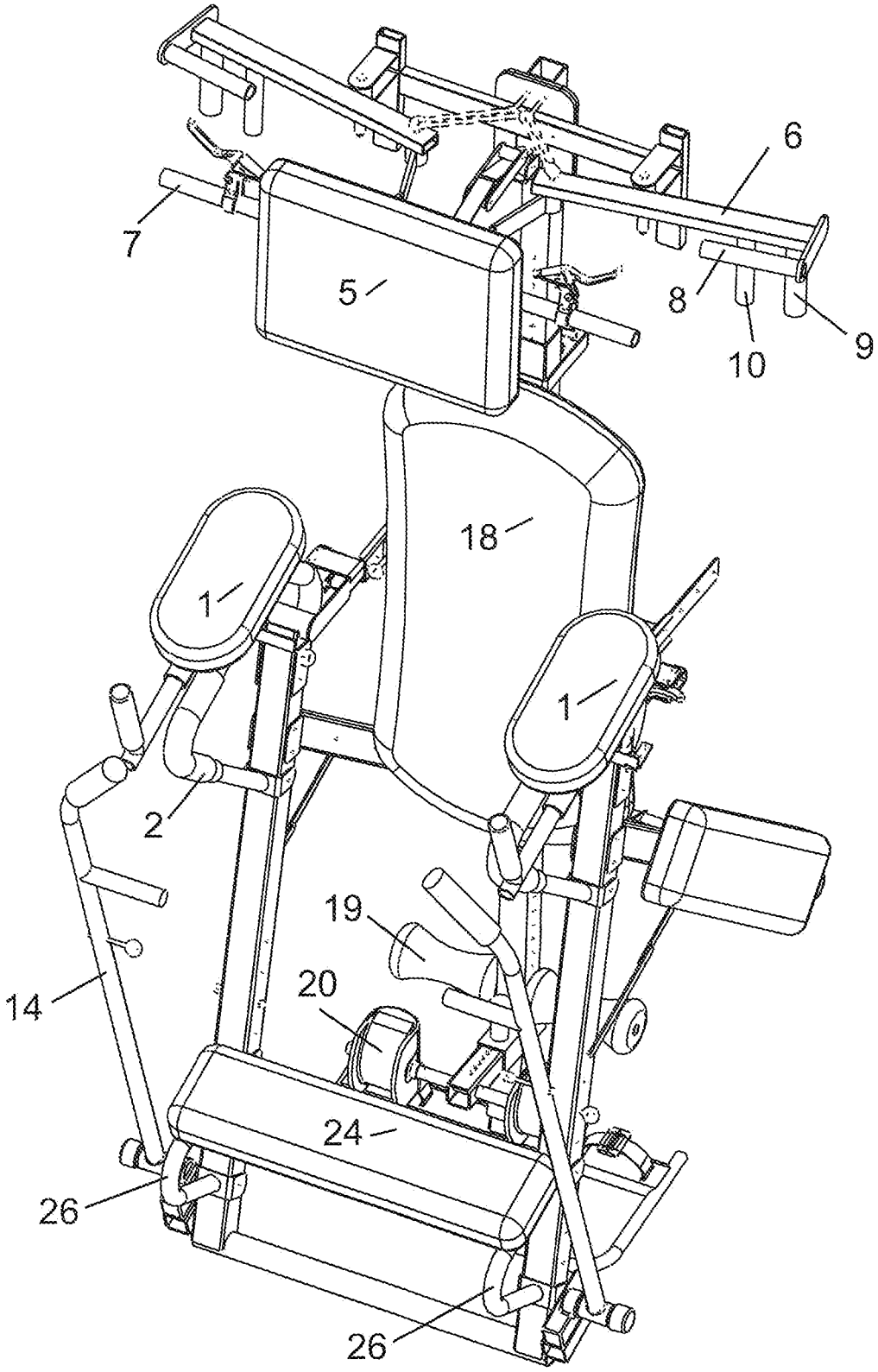
FIG. 2 is a perspective view of the apparatus in a vertical position.
Figure 3:
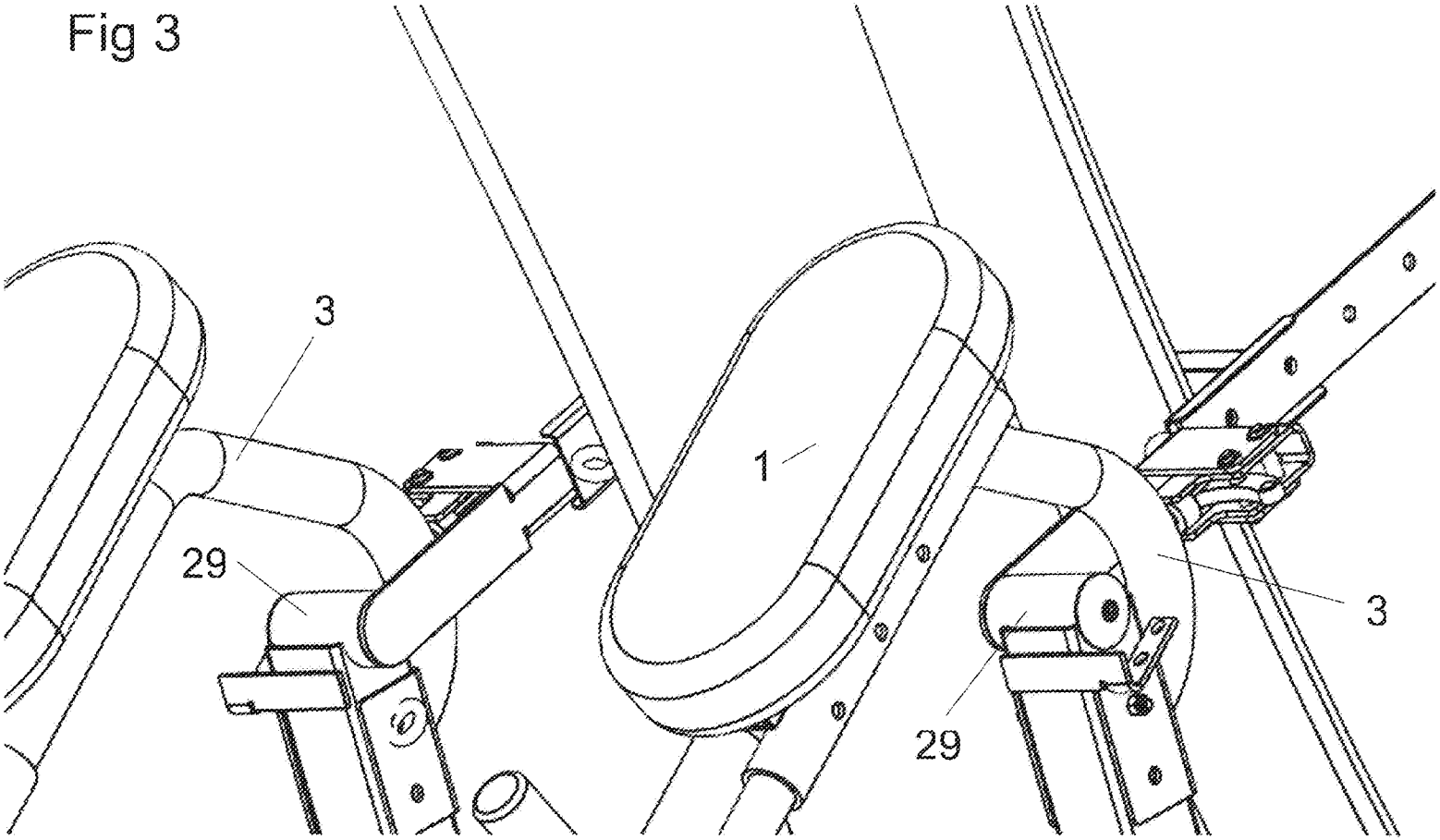
FIGS. 3 and 4 are enlarged views showing detailed features of the apparatus.
Figure 4:
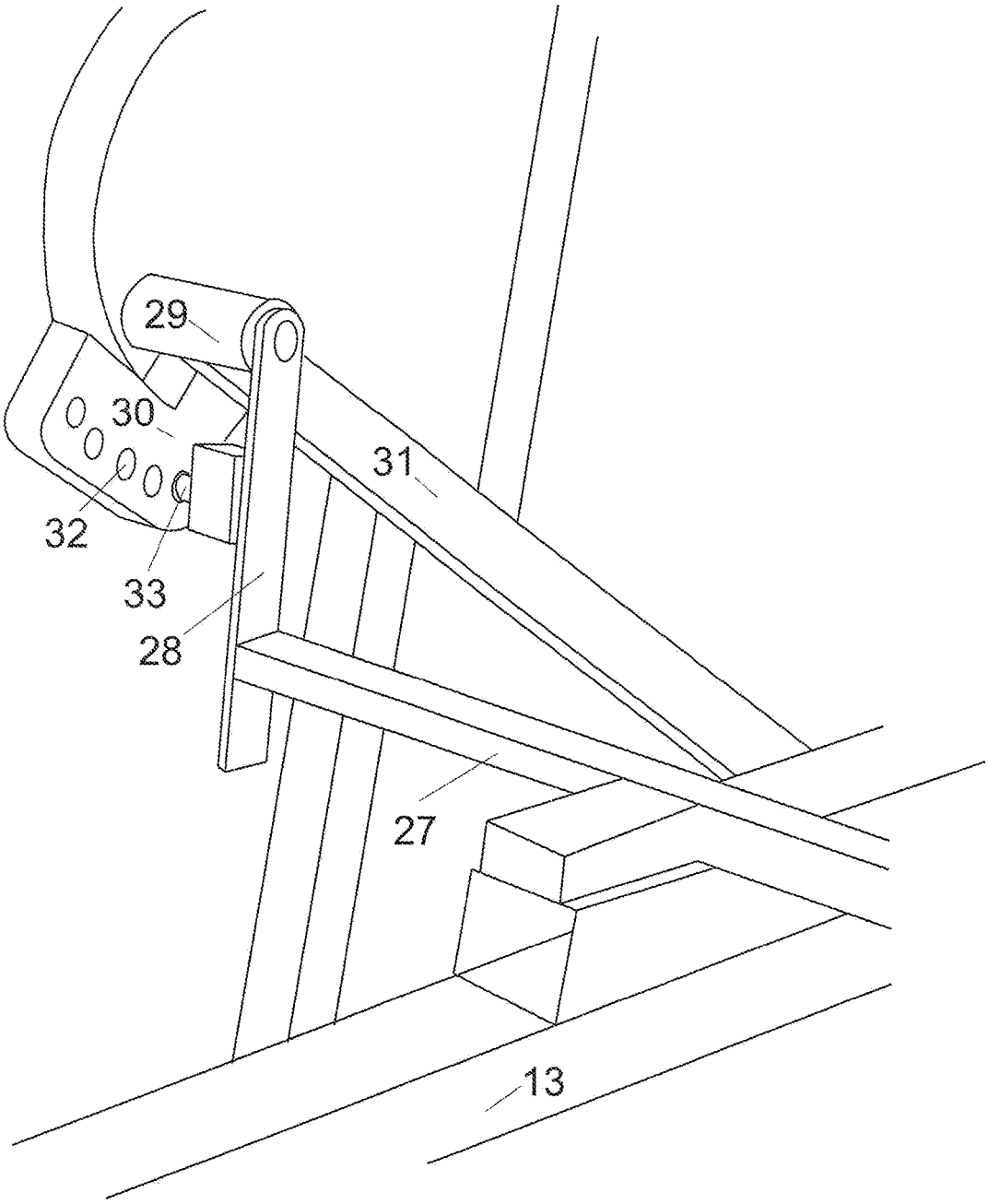

In order to maneuver the apparatus as shown in FIG. 1 to the position shown in FIG. 2, and as best shown in FIG. 4, crossbar 27 is provided which extends over and is interconnected to telescoping tube 13. Each end of crossbar 27 is attached to upwardly extending flange 28. The end of each flange 28 remote from crossbar 27, is rotationally interconnected to journal 29. Plate 30 is attached to angular support bar 31 and includes multiple apertures 32 formed therein. Spring-biased pin 33 is operable for selective engagement with apertures 32 to fix body pad 18 in the desired position when body support section A and foot anchoring section C are rotated about journals 29.

The invention claimed is:

1. A multifunctional pushup table comprising:

a free standing frame;

a body supporting section pivotally coupled to said freestanding frame and comprising a body pad configured to directly support a body of a user thereupon;

a pushup enabling section connected to a first end of said body supporting section;

a foot anchoring section interconnected to a second end of said body supporting section opposite the first end; and said pushup enabling section operable when said body supporting section is at an upright position, a horizontal position, and an intermediate position relative to said freestanding frame.

2. The multifunctional pushup table of claim 1, wherein said freestanding frame includes an A-frame supported on a ground surface.

3. The multifunctional pushup table of claim 1, wherein said foot anchoring section and said pushup enabling section are each laterally adjustable with respect to said body supporting.

4. The multifunctional pushup table of claim 1, wherein said foot anchoring section is located remote from said pushup enabling section.

5. The multifunctional pushup table of claim 3, wherein said pushup enabling section is adjustable with respect to said body supporting section by means of a telescoping tube.

6. The multifunctional pushup table of claim 1, wherein said pushup enabling section comprises:

a base portion adjustably attached to said body supporting section;

a cushion portion configured to support an upper torso of a user's body; and a pair of spaced hand grips interconnected to said base portion.

7. The multifunctional pushup table of claim 6, wherein a pair of spaced outer hand grips are interconnected to said base portion.

8. The multifunctional pushup table of claim 7, wherein a pair of inner hand grips are disposed parallel to said pair of spaced outer hand grips and respectively spaced therefrom.

9. The multifunctional pushup table of claim 8, wherein said pair of inner hand grips and said pair of spaced outer hand grips are each disposed perpendicular to said pair of spaced hand grips.

10. The multifunctional pushup table of claim 6, wherein said pushup enabling section is operated independently of said body supporting section and said foot anchoring section.

* * * * *